US012742334B2

(12) United States Patent
Martinez

(10) Patent No.: US 12,742,334 B2
(45) Date of Patent: Sep. 22, 2026

(54) CONCRETE FORM BRACKET

(71) Applicant: Gilbert Martinez, Tucson, AZ (US)

(72) Inventor: Gilbert Martinez, Tucson, AZ (US)

( * ) Notice: Subject to any disclaimer, the term of this patent is extended or adjusted under 35 U.S.C. 154(b) by 108 days.

(21) Appl. No.: 19/005,965

(22) Filed: Dec. 30, 2024

(65) Prior Publication Data

US 2026/0185366 A1 Jul. 2, 2026

(51) Int. Cl.
*E04G 17/14* (2006.01)
*E04G 17/00* (2006.01)

(52) U.S. Cl.
CPC ..... *E04G 17/14* (2013.01); *E04G 2017/008* (2013.01)

(58) Field of Classification Search
CPC ..... E04G 17/14; E04G 17/06; E04G 17/042; E04G 2017/008
USPC ..... 249/213
See application file for complete search history.

(56) References Cited

U.S. PATENT DOCUMENTS 4,433,826 A * 2/1984 Schimmel ..... E04G 17/045 249/165
4,635,895 A * 1/1987 Johnson, Jr. ..... E04G 13/00 249/219.1
5,076,536 A * 12/1991 Fitzgerald ..... E01C 19/502 403/108
5,096,155 A * 3/1992 Fitzgerald ..... E04G 17/04 403/374.2
5,817,247 A * 10/1998 Colatruglio ..... E01C 19/502 249/207
5,843,327 A * 12/1998 Lindgren ..... E04G 17/042 249/219.1
6,536,737 B1 * 3/2003 Davis ..... E04G 13/00 249/210
7,097,147 B2 * 8/2006 Shaw ..... E04G 21/16 52/169.8
7,832,163 B2 * 11/2010 Krzowski ..... E01C 11/08 52/364
11,149,450 B2 * 10/2021 White ..... E04G 17/002
11,306,493 B2 * 4/2022 White ..... E04G 13/00
2010/0218438 A1 * 9/2010 Sollars ..... E04G 13/00 52/127.2
2011/0210234 A1 * 9/2011 Garcia, Jr. ..... E04G 17/14 249/213
2012/0260596 A1 * 10/2012 Boese ..... E04B 1/16 52/426
2016/0076262 A1 * 3/2016 Scott ..... E04G 17/14 249/219.2
2016/0194887 A1 * 7/2016 White ..... E04G 17/14 248/351
2020/0232219 A1 * 7/2020 Lamm ..... E04G 17/12
2021/0040754 A1 * 2/2021 Hansort ..... E04G 17/14
(Continued)

*Primary Examiner* — Paola Agudelo
(74) *Attorney, Agent, or Firm* — Eugene Vamos

(57) ABSTRACT

The Concrete Form Bracket is a device used in construction, providing horizontal reinforcement to formwork used in shaping concrete structures during concrete pours. The Concrete Form Bracket prevents formwork from displacing horizontally ("blowing out"). The Concrete Form Bracket comprises a first arm, a second arm, and a transversal arm brace. One of the arms of the Concrete Form Bracket is placed against the formwork and the other arm is placed against the ground. Two stakes are inserted through one of the arms into the ground. Nails are inserted through the other arm into the formwork.

4 Claims, 3 Drawing Sheets

(56) References Cited

U.S. PATENT DOCUMENTS

| | | | | |
|---|---|---|---|---|
| 2023/0366221 | A1* | 11/2023 | Nichols | E04G 17/14 |
| 2024/0068250 | A1* | 2/2024 | Reinhardt | E04G 21/26 |
| 2024/0263465 | A1* | 8/2024 | Bae | E04G 11/08 |
| 2025/0003242 | A1* | 1/2025 | Haeberle | E04G 17/045 |

* cited by examiner

CONCRETE FORM BRACKET

BRIEF DESCRIPTION OF THE INVENTION

The Concrete Form Bracket (100) is a device used in construction, providing horizontal reinforcement to formwork (95) used in shaping concrete structures during concrete pours. The Concrete Form Bracket prevents formwork from displacing horizontally ("blowing out"). The Concrete Form Bracket comprises a first arm (200), a second arm (300), and a transversal arm brace (400). One of the arms of the Concrete Form Bracket (100) is placed against the formwork and the other arm is placed against the ground. Two stakes are inserted through one of the arms into the ground. Nails are inserted through the other arm into the formwork (95).

BACKGROUND OF INVENTION

1 Prior Art

Figure 2:
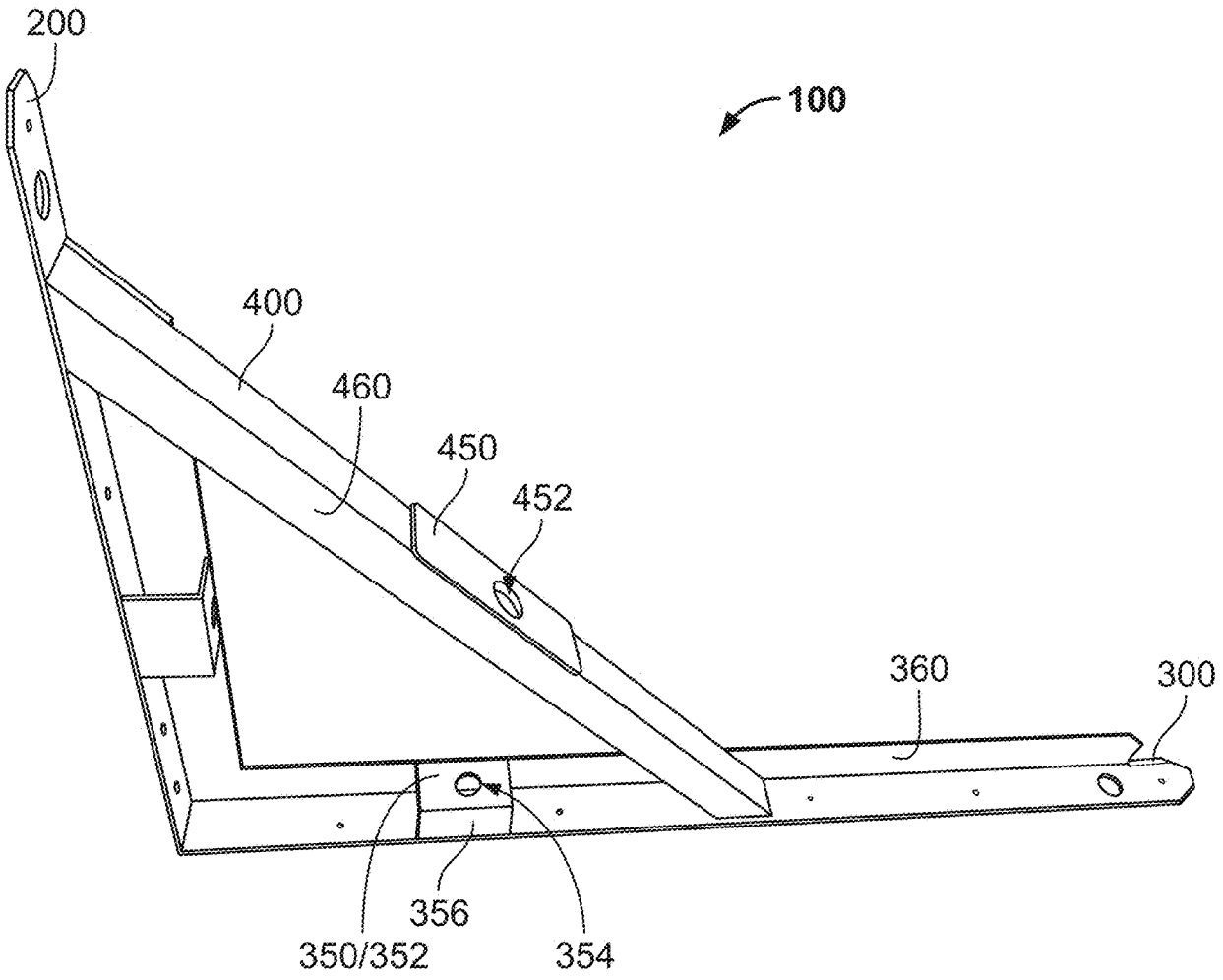
FIG. 2 shows a side perspective view of the Concrete Form Bracket (100)

Supporting formwork (95) is a critical part of the construction process to ensure that the formwork (95) holds its shape and capacity while the concrete sets and cures. Five common ways to support formwork (95) during construction projects are described below.

1.1 Shoring

Shoring involves the use of temporary vertical supports to hold up the formwork (95) during the pouring and curing process. These supports prevent the formwork (95) from collapsing under the weight of the wet concrete. Shoring can be made from various materials, including steel, wood, or aluminum and is commonly used for large or tall formwork, such as walls or columns. The system usually consists of adjustable props or posts that are spaced evenly to distribute the load.

For large concrete slabs or beams, adjustable steel props or aluminum shores are set up to support the formwork (95) until the concrete is strong enough to bear its own weight.

2 Bracing

Bracing provides lateral stability to the formwork (95) and prevents it from tipping or shifting during the pour. Braces can be installed diagonally from the formwork (95) to the ground or to a stable structure like a scaffold. This method is often used for both horizontal and vertical formwork (95), especially when the formwork (95) is large or when the poured concrete is heavy.

Diagonal braces between the formwork (95) and the ground can prevent the formwork (95) from shifting during the concrete pour of large foundation walls or slabs.

3 Use of Formwork Systems

Modular formwork systems (e.g., prefabricated steel, plastic, or plywood panels) come with their own built-in support structure, which helps reduce the need for additional shoring or bracing. These systems can be adjusted, stacked, or reconfigured depending on the dimensions of the pour. They are commonly used in repetitive projects like residential foundations, commercial buildings, and industrial construction, as they are easy to set up and adjust.

Panel formwork systems used for slab and wall construction are often self-supporting, with integrated ties and spacers that maintain the correct alignment and spacing.

3.1 Falsework

Falsework refers to temporary structures used to support formwork (95) while the concrete is being poured and cured. It includes both horizontal and vertical supports, and is typically used in bridges, arches, or other large-scale structures where the formwork (95) needs to be held in place for an extended period before the concrete hardens sufficiently. Falsework includes beams, columns, and bracing systems.

In bridge construction, falsework consists of scaffolding or steel beams that hold the formwork (95) in position until the concrete deck is strong enough to support its own weight.

3.2 Tensioned Cables or Struts

For particularly large or complex formwork (95), especially in the construction of curved or arched surfaces, tensioned cables or struts may be used. These can be placed to prevent the formwork (95) from buckling or collapsing under the pressure of the wet concrete. Tensioned cables or steel struts are often employed in conjunction with other support systems to provide additional stability.

In the construction of a curved concrete roof, tensioned cables may be used to hold the form in place, ensuring the formwork (95) doesn't distort under the load of the concrete.

3.3 Summary

These support methods ensure that formwork (95) remains stable, aligned, and able to carry the weight of wet concrete during the pouring and curing processes. The choice of method depends on the size and complexity of the formwork (95), the type of structure being built, and the local environmental conditions. Proper planning and the use of suitable materials are essential for safe and efficient concrete construction.

4 Disadvantages of Prior Art

Concrete formwork (95) supports are essential components in the construction of concrete structures, but they also come with several disadvantages. These disadvantages can impact cost, safety, time efficiency, and quality of work. Here are the main drawbacks:

4.1 High Initial Costs

The cost of materials (such as steel, aluminum, or wood) used for formwork (95) can be quite high. While wooden formwork (95) may be less expensive, it might not be as durable as metal or plastic forms, which are often more expensive upfront.

The assembly, installation, and dismantling of formwork systems require skilled labor, which can add to the cost of the overall project.

4.2 Labor-intensive Installation

Setting up formwork (95), especially for large or complex structures, requires significant time and effort. Labor-intensive processes increase both time and costs. This is especially true with traditional formwork systems, which might require more workers for assembly and adjustment.

4.3 Limited Reusability

Traditional formwork (95), especially when made from wood, can only be reused a limited number of times before it deteriorates. Even metal formwork systems, while more durable, have a limited number of uses depending on the quality of maintenance and storage.

Over time, the reusability of formwork systems reduces, leading to increased costs for replacement materials.

4.4 Storage and Transportation Issues

Formwork components, especially large and heavy systems like steel and aluminum panels, can be difficult to store and transport. This takes up space on construction sites and can lead to logistical challenges, including the risk of damage during handling or transport.

4.5 Increased Risk of Errors and Inconsistent Quality

Formwork systems that are improperly assembled can result in misalignments or uneven surfaces in the final concrete structure. Errors in formwork installation can lead to defects in the concrete, such as surface imperfections, misalignment of structural elements, or compromised load-bearing capacity.

Inconsistent quality control of formwork systems can affect the overall quality of the finished structure.

4.6 Structural Safety Concerns

If the formwork (95) is not properly designed or installed, there is a risk of formwork collapse during concrete pouring or curing. This poses significant safety risks to workers and can lead to delays, accidents, and additional costs.

For high-rise buildings or large spans, ensuring the structural integrity of formwork (95) becomes even more critical, as formwork failures can be catastrophic.

4.7 Limited Flexibility

Traditional formwork systems often lack flexibility when it comes to adapting to complex or irregularly shaped designs. While modular formwork can accommodate different shapes to some extent, it can be difficult to make on-the-fly adjustments, especially when changes are needed after installation.

4.8 Environmental Impact

The production and disposal of formwork materials, particularly timber, can have negative environmental consequences. Wood is often sourced from forests, leading to deforestation, and steel or aluminum formwork can be energy-intensive to produce.

Non-durable formwork materials also result in more waste, especially if they cannot be recycled or reused effectively.

4.9 Time Delays Due to Weather Conditions

Weather conditions such as rain, heat, or extreme cold can interfere with formwork assembly or the curing of concrete. While formwork (95) itself is designed to hold the concrete in place, adverse weather can delay the entire construction process, especially for outdoor projects.

4.10 Maintenance Requirements

Metal formwork systems, while durable, require regular maintenance to prevent rust, corrosion, or other forms of wear. This increases operational costs and the time spent on upkeep.

Similarly, wooden formwork (95) requires care to prevent warping, splintering, or damage during use.

4.11 Complexity in Removal

Dismantling formwork (95) can sometimes be complex and time-consuming, especially in high or complicated structures. If formwork (95) is not removed correctly, it can damage the newly poured concrete, resulting in costly repairs or delays.

4.12 Weight and Transport

Heavy concrete formwork materials (like steel frames) can add to the burden of transporting and handling, requiring specialized equipment such as cranes or forklifts. This adds to both logistics costs and the potential for accidents or delays on-site.

4.13 Conclusion

While concrete formwork supports are essential to the construction of safe and durable structures, their disadvantages—particularly regarding cost, labor, and potential safety hazards—must be considered carefully. Advances in modular and reusable formwork technologies, as well as innovations in materials like plastic or composite forms, are helping to mitigate some of these issues, but traditional systems still pose significant challenges.

Definitions formwork—Mold used to form concrete into structural shapes (beams, columns, slabs, shells) for building.

Detailed Description of the Invention

The Concrete Form Bracket (100) is a device used in construction, providing horizontal reinforcement to formwork (95) used in shaping concrete structures during concrete pours. The Concrete Form Bracket prevents formwork from displacing horizontally ("blowing out"). The Concrete Form Bracket comprises a first arm (200), a second arm (300), and a transversal arm brace (400). One of the arms of the Concrete Form Bracket (100) is placed against the formwork and the other arm is placed against the ground. Two stakes are inserted through one of the arms into the ground. Nails are inserted through the other arm into the formwork (95). The design of the Concrete Form Bracket (100) is integral and modular, facilitating installation, transportation and maintenance.

The Concrete Form Bracket (100) comprises a first arm (200), a second arm (300), and a transversal arm brace (400). FIG. 2 shows the Concrete Form Bracket (100) comprising a first arm (200), a second arm (300), and a transversal arm brace (400)

1 First Arm (200)

Figure 1:
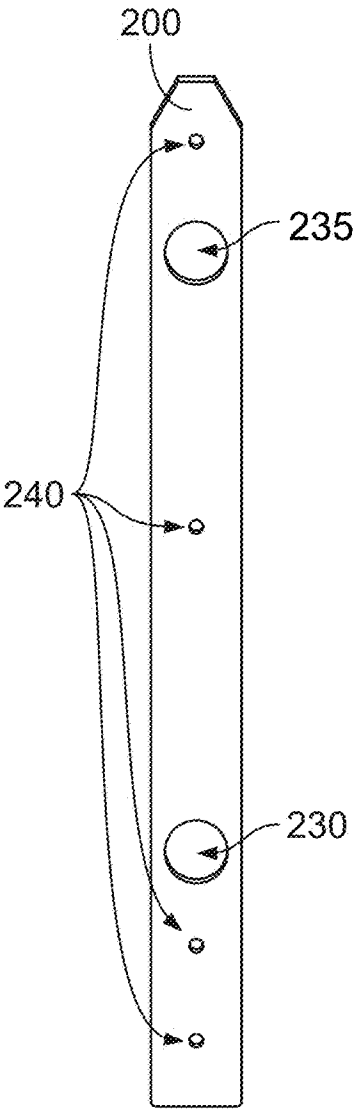
FIG. 1 shows a front elevation view of the first arm (200) of the Concrete Form Bracket (100), where the first arm (200) of the Concrete Form Bracket (100) comprises a stake hole (230) and a plurality of nail-sized holes (240)
Figure 3:
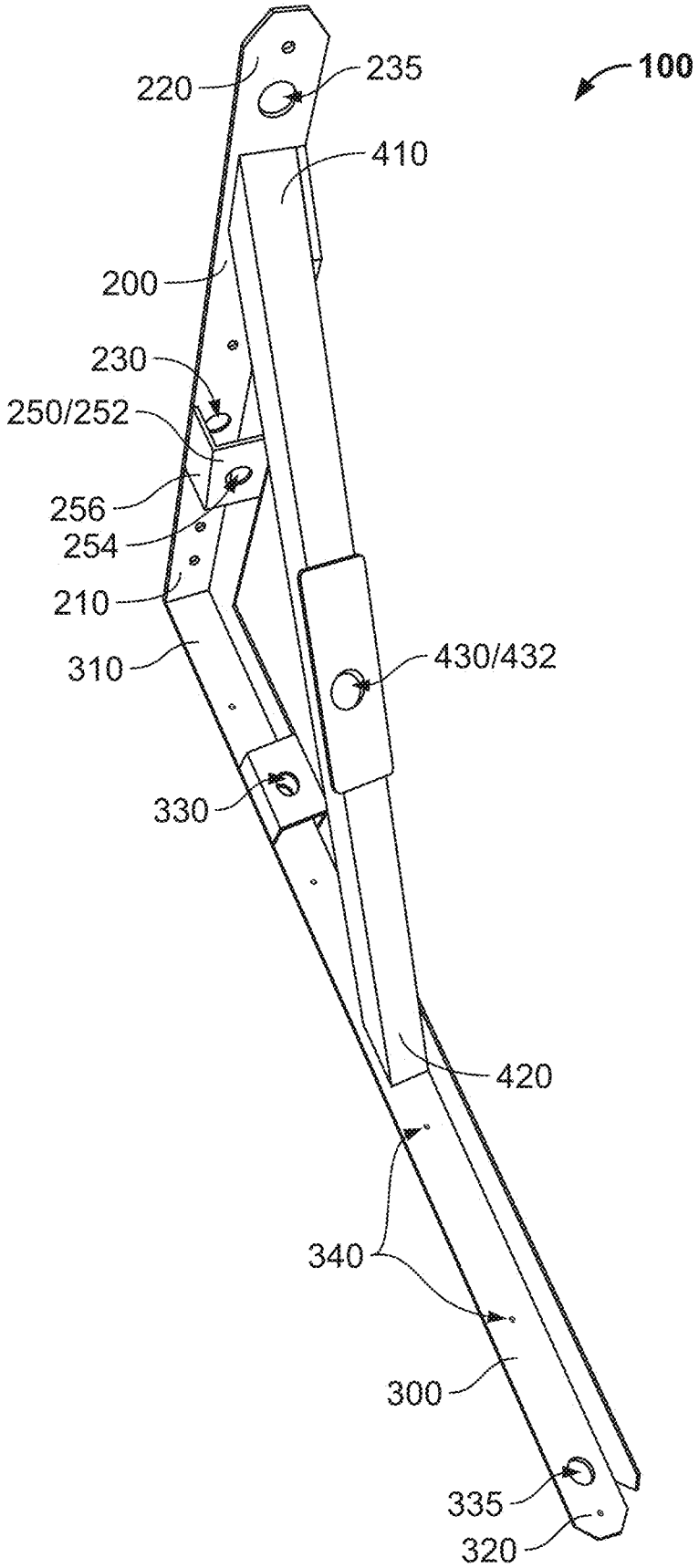
FIG. 3 shows a back top right perspective view of the Concrete Form Bracket (100)

The first arm (200) comprises a first stake hole (230), a second stake hole (235), a plurality of nail-sized holes (240), and a stake support structure (250). The first arm (200) further comprises a first end (210) and a second end (220). The first stake hole (230) is located closest to the first end (210) of the first arm (200), and the second stake hole (235) is located closest to the second end (220) of the first arm (200). FIG. 1 and FIG. 3 shows the elements of the first arm (200).

The first arm (200) further comprises a width and a length.

The stake support structure (250) secures a concrete stake (90) to the first arm (200) when the concrete stake (90) is inserted through the stake hole (430) of the transversal arm brace (400), the hole (254) of the top piece (252) of the stake support structure (250), and the first stake hole (230) of the first arm (200).

The stake support structure (250) comprises a top piece (252) and a first leg (256). The top piece (252) comprises a hole (254). The first leg (256) is oriented perpendicular to the first arm (200) and the top piece (252). The stake support structure (250) may further comprise a second leg (258). When both are present, the first leg (256) and the second leg (258) are oriented parallel to each other and perpendicular to the first arm (200) and the top piece (252) of the stake support structure (250).

The hole (254) of the stake support structure (250) is located over the first stake hole (230) of the first arm (200), so that the center of the hole (254) of the stake support structure (250) is aligned to the center of the first stake hole (230) of the first arm (200).

The first arm (200) may further comprise a lateral support structure (260). The lateral support structure (260) provides increased support to the Concrete Form Bracket (100). The lateral support structure (260) is a rectangular band oriented perpendicular to the first arm (200). The lateral support structure (260) is joined to the first arm (260) either integrally or joined through welding, bolting, or other state of the art joining technique. The lateral support structure (260) is jointed lengthwise to either of the sides of the first arm (200).

The nail-sized holes (240) of the first arm (200) are distributed through out the first arm (200). The nail-sized holes (240) allow for nails (92) to be driven through the nail-sized holes (240) to secure the Concrete Form Bracket (100) against the formwork (95).

The stake support structure (250) is attached to the first arm (200). When the stake support structure (250) does not comprise a lateral support structure (260), the first leg (256) and the second leg (258) are attached to the first arm (200). When the stake support structure (250) does comprise a lateral support structure (260), the first leg (256) is attached to the first arm (200) and the top piece is attached to the lateral support structure (260).

2 Second Arm (300)

The second arm (300) comprises a first stake hole (330), a second stake hole (235), a plurality of nail-sized holes (340), and a stake support structure (350). The second arm (300) further comprises of a first end (310) and a second end (320). The first stake hole (330) is located closest to the first end (310) of the second arm (300), and the second stake hole (335) is located closest to the second end (320) of the second arm (300). FIG. 3 shows the elements of the second arm (300).

The second arm (300) further comprises a width and a length.

The stake support structure (350) secures a concrete stake (90) to the second arm (300) when the concrete stake (90) is inserted through the stake hole (430) of the transversal arm brace (400), the hole (354) of the top piece (352) of the stake support structure (350), and the first stake hole (330) of the second arm (300).

The stake support structure (350) comprises a top piece (352) and a first leg (356). The top piece (352) comprises a hole (354). The first leg (356) is oriented perpendicular to the second arm (300) and the top piece (352). The stake support structure (350) may further comprise a second leg (358). When both are present, the first leg (356) and the second leg (358) are oriented parallel to each other and perpendicular to the second arm (300) and the top piece (352) of the stake support structure (350).

The hole (354) of the stake support structure (350) is located over the first stake hole (330) of the second arm (300), so that the center of the hole (354) of the stake support structure (350) is aligned to the center of the first stake hole (330) of the second arm (300).

The second arm (300) may further comprise a lateral support structure (360). The lateral support structure (360) provides increased support to the Concrete Form Bracket (100). The lateral support structure (360) is a rectangular band oriented perpendicular to the second arm (300). The lateral support structure (360) is joined to the second arm (300) either integrally or joined through welding, bolting, or other state of the art joining technique. The lateral support structure (360) is jointed lengthwise to either of the sides of the second arm (300).

The nail-sized holes (340) of the second arm (300) are distributed through out the second arm (300). The nail-sized holes (340) allow for nails (92) to be driven through the nailsized holes (340) to secure the Concrete Form Bracket (100) against the formwork (95).

The stake support structure (350) is attached to the second arm (300). When the stake support structure (350) does not comprise a lateral support structure (360), the first leg (356) and the second leg (358) are attached to the second arm (300). When the stake support structure (350) does comprise a lateral support structure (360), the first leg (356) is attached to the second arm (300), and the top piece (352) is attached to the lateral support structure (360).

FIG. 2 shows the elements of the stake support structure (250).

3 Transversal Arm Brace (400)

The transversal arm brace (400) provides structural reinforcement to the Concrete Form Bracket (100), providing a diagonal connection between the first arm (200) and the second arm (300). The transversal arm brace (400) comprises of one stake hole (430) or two stake holes (430)—a first stake hole (432) and a second stake hole (434). The transversal arm brace (400) further comprises of a first end (410) and a second end (420).

The transversal arm brace (400) further comprises a width and a length.

The transversal arm brace (400) may further comprise a reinforcement plate (450). The reinforcement place (450) ensures the structural integrity of the transversal arm brace (400) when stakes (90) are placed through the transversal arm brace holes (430). The reinforcement plate comprises one or two holes (452).

Figure 4:
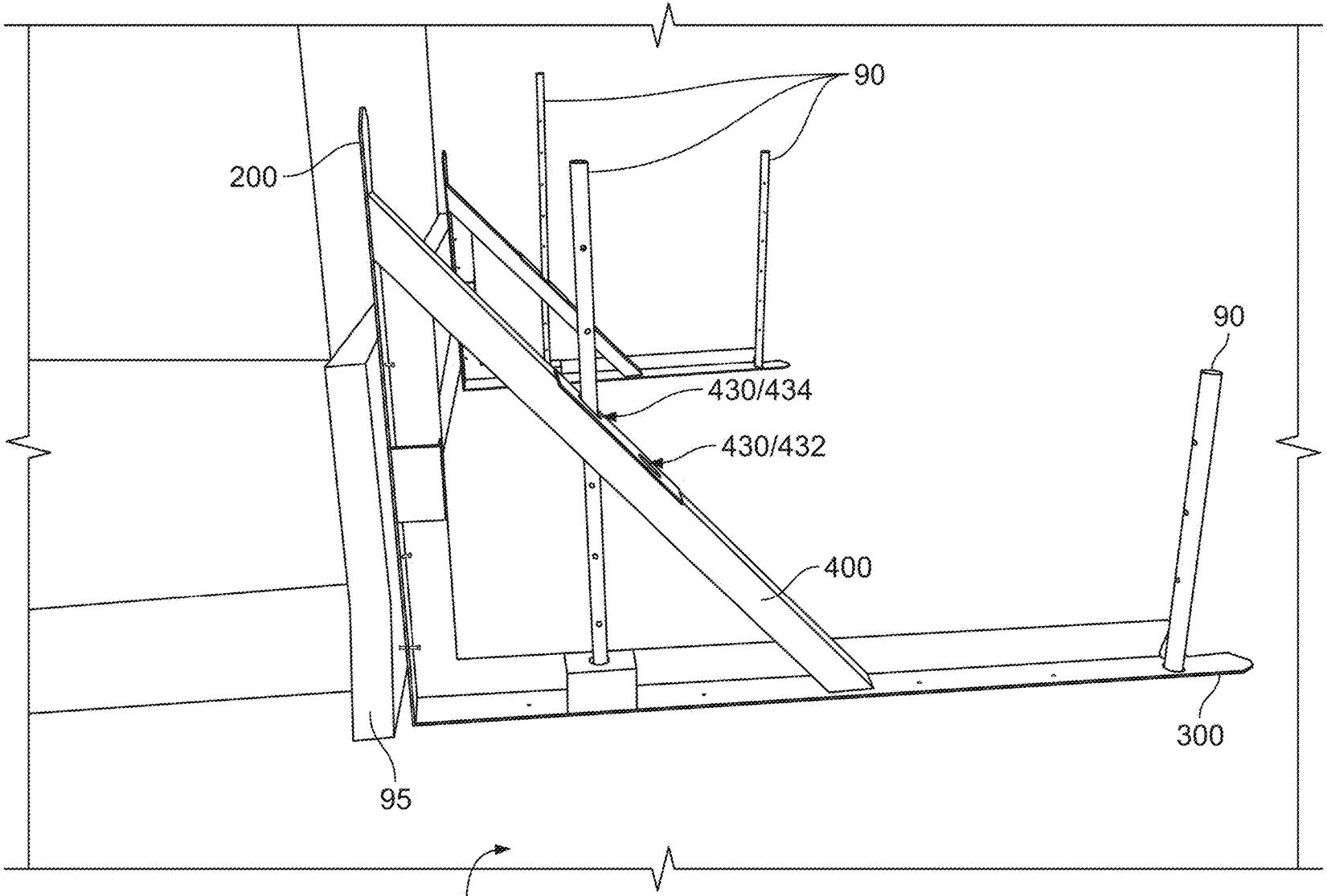
FIG. 4 shows the Concrete Form Bracket (100) attached to formwork (95), where nails (92) are placed through the nail-sized holes (240) of the first arm (200) of the Concrete Form Bracket (100) into the formwork (95).

The reinforcement plate holes (452) are substantially the same size and shape as the corresponding transversal arm brace holes (430). The reinforcement plate (450) attaches to the transversal arm brace (400) so that the transversal arm brace stake holes (430) are aligned concentrically to the reinforcement plate stake holes (452). FIG. 2 shows a reinforcement plate (450) attached to the transversal arm brace (400) with one hole. FIG. 4 shows a reinforcement plate (450) attached to the transversal arm brace (400) with two holes.

When the transversal arm brace (400) comprises one stake hole (430), the reinforcement plate (450) comprises one stake hole (452). The reinforcement plate (450) attaches to the transversal arm brace (400) so that the transversal arm brace stake hole (430) is aligned concentrically to the reinforcement plate stake hole (452).

When the transversal arm brace (400) comprises two stake holes (430), the reinforcement plate (450) comprises two stake holes (452)—a first stake hole and a second stake hole. The reinforcement plate (450) attaches to the transversal arm brace (400) so that the first transversal arm brace stake hole (430) is aligned concentrically to the first reinforcement plate stake hole (452) and the second transversal arm brace stake hole (430) is aligned concentrically to the second reinforcement plate stake hole (452).

In a one stake hole configuration, the transversal arm brace (400) comprises one stake hole (430). The stake hole (430) of the transversal arm brace (400) is located along the transversal arm brace (400) so that a) the stake hole (430) of the transversal arm brace (400) and the stake hole (230) of the first arm (200) are concentrically aligned and b) the stake hole (430) of the transversal arm brace (400) and the stake hole (330) of the second arm (300) are concentrically aligned.

Hence, a) a concrete stake (90) can be placed parallel to the first arm (200) through the stake hole (430) of the transversal arm brace (400) and the stake hole (330) of the second arm (300), and b) a concrete stake (90) be placed parallel to the second arm (300) through the stake hole (430) of the transversal arm brace (400) and the stake hole (230) of the first arm (200).

FIG. 3 shows a concrete form bracket (100) that has a transversal arm brace (400) with a one stake hole (430) configuration.

In a two stake hole configuration, the transversal arm brace (400) comprises two stake holes (430)—a first stake hole (432) and a second stake hole (434). The first stake hole (432) of the transversal arm brace (400) is located along the transversal arm brace (400) so that the first stake hole (432) of the transversal arm brace (400) and the stake hole (230) of the first arm (200) are concentrically aligned. The second stake hole (434) of the transversal arm brace (400) is located along the transversal arm brace (400) so that the second stake hole (432) of the transversal arm brace (400) and the stake hole (230) of the second arm (300) are concentrically aligned.

Hence, a) a concrete stake (90) can be placed parallel to the first arm (200) through the second stake hole (434) of the transversal arm brace (400) and the stake hole (330) of the second arm (300), and b) a concrete stake (90) be placed parallel to the second arm (300) through the first stake hole (432) of the transversal arm brace (400) and the stake hole (230) of the first arm (200). This configuration allows a concrete stake (90) to be placed at two different lengths away from the formwork (95), depending on whether the first arm or the second arm is placed against the formwork (95).

FIG. 4 shows a Concrete Form Bracket (100) that has a transversal arm brace (400) with a two stake hole (430) configuration.

Diagonal bracing provides reinforcement for right angle structures primarily by increasing the ability to resist lateral forces and maintaining structural stability.

Resisting Lateral Loads. Right angle structures, like rectangles or squares, are inherently weak against forces acting diagonally, such as wind, seismic activity, or uneven loads. These forces can cause deformation or collapse if not properly resisted. A diagonal brace transforms a flexible L shape into a rigid triangular section. Triangles are inherently stable geometric shapes because their angles and sides remain fixed under stress.

Force Redistribution. Diagonal bracing helps redistribute forces along the brace, effectively spreading the load across the structure. It redirects lateral forces into axial forces (compression or tension) in the brace, which are more efficiently handled by structural members than bending or shearing forces.

Improved Stiffness and Stability. Adding diagonal bracing increases the stiffness of a structure, reducing deflection and vibration under dynamic or static loads. It ensures the structure remains rigid and aligned, even under varying load conditions.

4 Assembly of the Concrete Form Bracket (100)

The first end (210) of the first arm (200) is joined to first end (310) of the second arm (300) at a right angle either integrally or joined through welding, bolting, or other state of the art joining technique.

The first end of the transversal arm brace (400) is joined to the first arm (200) at an angle alpha ($\alpha$) and the second end of the transversal arm brace (400) is joined to the second arm (300) at an angle beta ($\beta$). The first end of the transversal arm brace (400) is joined to the first arm (200) between the first stake hole (230) and the second stake hole (235) of the first arm (200). The first end of the transversal arm brace (400) is joined to the second arm (300) between the first stake hole (330) and the second stake hole (335) of the second arm (300).

The stake support structure (250) of the first arm (200) is located between the joint of the first arm (200) and the second arm (300) and the joint of the first arm (200) and the transversal arm brace (400). The stake support structure (350) of the second arm (300) is located between the joint of the first arm (200) and the second arm (300) and the joint of the second arm (300) and the transversal arm brace (400). FIG. 3 shows the placement of the stake support structure (250) of the first arm (200) and stake support structure (350) of the second arm (300) relative to the first arm (200), the second arm (300), and the transversal arm brace (400).

The selection of the corresponding $\alpha$ and $\beta$ angles will differ with the required bracing force that the Concrete Form Bracket (100) provides as a function of the first arm (200) length, second arm length (300), and the transversal arm brace (400) length. Preferably $\alpha$ and $\beta$ may range from 20 to 70 degrees. For example, $\alpha$ and $\beta$ maybe equal, as FIG. 4 shows. In another example $\alpha$ maybe double that of $\beta$, or $\beta$ maybe double that of $\alpha$, forming a 30:60:90 triangle.

In an embodiment of the Concrete Form Bracket (100), the length (204) of the first arm (200) and the length (304) of the second arm (300) are substantially similar.

In another embodiment of the Concrete Form Bracket (100), the length (204) of the first arm (200) and the length (304) of the second arm (300) are different, either the first arm (200) is longer than the second arm (300) or the second arm (300) is longer than the first arm (200). Having the first arm (200) and the second arm (300) at different lengths allows of greater flexibility for usage of the Concrete Form Bracket (100). In certain situations, the longer arm could be placed against the ground (97) and the shorter arm could be placed against the formwork (95). In other situations, the longer arm could be placed against the formwork (95) and the shorter arm could be placed against the ground (97).

For example, the first arm (200) may have a length of approximately 36 inches and a width of approximately two inches. The second arm (300) may have a length of approximately 24 inches and a width of approximately two inches. The transversal arm brace (400) may have a length of approximately 29 inches and a width of approximately two inches. In this example, the stake support structure (250) of the first arm (200) is located around 11-12 inches from the joint of the first arm (200) and the second arm (300) and the stake support structure (350) of the second arm (300) is located around 10-12 inches from the joint of the first arm (200) and the second arm (300).

5 Usage of the Concrete Form Bracket (100)

The Concrete Form Bracket (100) provides horizontal reinforcement to formwork (95) used in shaping concrete structures during concrete pours. It prevents formwork (95) from displacing horizontally ("blowing out")

One of the arms of the Concrete Form Bracket (100) is placed against the formwork (95) and the other arm is placed against the ground (97).

In a first usage embodiment of the Concrete Form Bracket (100), the first arm (200) is placed against the formwork (95) and the second arm (300) is placed against the ground (97). Nails (92) may be driven through the nail-sized holes (240) present in the first arm (200) to secure the Concrete Form Bracket (100) to the formwork (95). A first concrete stake (90) is inserted through the stake hole (430) of the transversal arm brace (400), the hole (354) of the top piece (352) of the stake support structure (350) of the second arm (300), and the first stake hole (330) of the second arm (300). A second concrete stake (90) is inserted through the second stake hole (335) of the second arm (300) and into the ground (97).

In a second usage embodiment of the Concrete Form Bracket (100), the second arm (300) is placed against the formwork (95) and the first arm (200) is placed against the ground (97). Nails (92) may be driven through the nail-sized holes (340) present in the second arm (300) to secure the Concrete Form Bracket (100) to the formwork (95). A first concrete stake (90) is inserted through the stake hole (430) of the transversal arm brace (400), the hole (254) of the top piece (252) of the stake support structure (250) of the first arm (200), and the first stake hole (230) of the first arm (200). A second concrete stake (90) is inserted through the second stake hole (235) of the first arm (200) and into the ground (97).

The diagonal bracing reinforcement provided by the Transversal Arm Brace (400) and the ability use stakes (90) and nails (92) to secure the positioning of the Concrete Form Bracket (100) to the formwork (95) and the ground (97) is novel and provides significant functional improvements over the prior art.

6 Clarifying Comments

While the foregoing written description of the invention enables a person having ordinary skill in the art to make and use what is considered presently to be the best mode thereof, those of ordinary skill in the art will understand and appreciate the existence of variations, combinations, and equivalents of the specific embodiment, process, and examples herein. The invention should therefore not be limited by the above described embodiment, process, and examples, but by all embodiments and processes within the scope and spirit of the invention.

The inventions shown and described herein may be used to address one or more of such problems or other problems not set out herein and/or which are only understood or appreciated at a later time. The future may also bring to light currently unknown or unrecognized benefits which may be appreciated, or more fully appreciated, in association with the inventions shown and described herein. The desires and expected benefits explained herein are not admissions that others have recognized such prior needs, since invention and discovery are both inventive under the law and may relate to the inventions described herein.

I claim:

1. A Concrete Form Bracket that provides horizontal reinforcement to formwork used in shaping concrete structures during concrete pours, the concrete form bracket comprising:

(a) a first arm; the first arm comprising:
- (i) a first end;
- (ii) a second end;
- (iii) a plurality of nail-sized holes;
- (iv) a first stake hole;
- (v) a second stake hole;
- (vi) where the first stake hole is located closest to the first end of the first arm and the second stake hole is located closest to the second end of the first arm,
- (vii) a lateral support structure;
  - (1) where the lateral support structure of the first arm is joined perpendicularly to the first arm,
- (viii) a stake support structure; the stake support structure comprising:
  - (1) a top piece; the top piece comprising a hole;
  - (2) a first leg;
  - (3) where the first arm and the top piece are joined at a right angle,
  - (4) where the top piece is joined to the lateral support structure at a right angle;

(b) a second arm; the second arm comprising:
- (i) a first end;
- (ii) a second end;
- (iii) a plurality of nail-sized holes;
- (iv) a first stake hole;
- (v) a second stake hole;
- (vi) where the first stake hole is located closest to the first end of the second arm and the second stake hole is located closest to the second end of the second arm;
- (vii) a lateral support structure;
  - (1) where the lateral support structure of the second arm is joined perpendicularly to the second arm;
- (viii) a stake support structure; the stake support structure comprising:
  - (1) a top piece; the top piece comprising a hole;
  - (2) a first leg;
  - (3) where the first arm and the top piece are joined at a right angle,
  - (4) where the top piece is joined to the lateral support structure at a right angle;

(c) a transversal arm brace; the transversal arm brace comprising:
- (i) a first end;
- (ii) a second end; and
- (iii) a stake hole;

(d) where the first end of the first arm is joined to the first end of the second arm at a right angle, (e) where the first end of the transversal arm brace is joined to the first arm, (f) where the second end of the transversal arm brace is joined to the second arm, (g) where the stake hole of the transversal arm brace is located along the transversal arm brace so that the stake hole of the transversal arm brace and the stake hole of the first arm are concentrically aligned and the stake hole of the transversal arm brace and the stake hole of the second arm are concentrically aligned.

2. The Concrete Form Bracket described in claim 1, (a) wherein the transversal arm brace further comprises a reinforcement plate, where the reinforcement plate comprises a stake hole;

(b) where the reinforcement plate stake hole is substantially the same size and shape as the transversal arm brace hole, (c) where the reinforcement plate is attached to the transversal arm brace so that the transversal arm brace hole is aligned concentrically to the reinforcement plate hole.

3. A Concrete Form Bracket that provides horizontal reinforcement to formwork used in shaping concrete structures during concrete pours, the concrete form bracket comprising:

(a) a first arm; the first arm comprising:
- (i) a first end;
- (ii) a second end;
- (iii) a plurality of nail-sized holes;
- (iv) a first stake hole;
- (v) a second stake hole;
- (vi) where the first stake hole is located closest to the first end of the first arm and the second stake hole is located closest to the second end of the first arm,
- (vii) a lateral support structure;
  - (1) where the lateral support structure of the first arm is joined perpendicularly to the first arm;
- (viii) a stake support structure; the stake support structure comprising:
  - (1) a top piece; the top piece comprising a hole;
  - (2) a first leg;
  - (3) where the first arm and the top piece are joined at a right angle,
  - (4) where the top piece is joined to the lateral support structure at a right angle;

(b) a second arm; the second arm comprising:
- (i) a first end;
- (ii) a second end;
- (iii) a plurality of nail-sized holes;
- (iv) a first stake hole;
- (v) a second stake hole;
- (vi) where the first stake hole is located closest to the first end of the second arm and the second stake hole is located closest to the second end of the second arm;
- (vii) a lateral support structure;
  - (1) where the lateral support structure of the second arm is joined perpendicularly to the second arm;
- (viii) a stake support structure; the stake support structure comprising:
  - (1) a top piece; the top piece comprising a hole;
  - (2) a first leg;
  - (3) where the first arm and the top piece are joined at a right angle,
  - (4) where the top piece is joined to the lateral support structure at a right angle;

(c) a transversal arm brace; the transversal arm brace comprising:
- (i) a first end;
- (ii) a second end;
- (iii) a first stake hole; and
- (iv) a second stale hole;

(d) where the first end of the first arm is joined to the first end of the second arm at a right angle, (e) where the first end of the transversal arm brace is joined to the first arm, (f) where the second end of the transversal arm brace is joined to the second arm, (g) where the first stake hole of the transversal arm brace is located along the transversal arm brace so that the first stake hole of the transversal arm brace and the stake hole of the first arm are concentrically aligned, (h) where the first stake hole of the transversal arm brace is located along the transversal arm brace so that the second stake hole of the transversal arm brace and the stake hole of the second arm are concentrically aligned.

4. The Concrete Form Bracket described in claim 3, (a) wherein the transversal arm brace further comprises a reinforcement plate, where the reinforcement plate comprises a first stake hole and a second stake hole;

(b) where the first reinforcement plate stake hole is substantially the same size and shape as the first transversal arm brace hole, (c) where the second reinforcement plate stake hole is substantially the same size and shape as the second transversal arm brace hole, (d) where the reinforcement plate is attached to the transversal arm brace so that
- (i) the first transversal arm brace hole is aligned concentrically to the first reinforcement plate hole,
- (ii) the second transversal arm brace hole is aligned concentrically to the second reinforcement plate hole.

* * * * *